United States Patent [19]

Stahlecker et al.

[11] Patent Number: 4,819,422

[45] Date of Patent: Apr. 11, 1989

[54] ARRANGEMENT FOR WINDING A DOUBLE YARN ONTO A CROSS-WOUND SPOOL

[76] Inventors: Fritz Stahlecker, Josef-Neidhart-Strasse 18, 7347 Bad Ueberkingen; Hans Stahlecker, Haldenstrasse 20, 7334 Suessen, both of Fed. Rep. of Germany

[21] Appl. No.: 105,544

[22] Filed: Oct. 8, 1987

[30] Foreign Application Priority Data

Nov. 8, 1986 [DE] Fed. Rep. of Germany ..... 3638185

[51] Int. Cl.[4] ..... D02G 3/28; B65H 54/28

[52] U.S. Cl. ..... 57/328; 242/42; 242/43 R

[58] Field of Search ..... 242/42, 43 R, 43 AB, 242/54.4, 155 R, 155 M, 150 R, 150 M, 157 R; 57/328

[56] References Cited

U.S. PATENT DOCUMENTS

| | | | |
|---|---|---|---|
| 1,190,169 | 7/1916 | Holt | 242/150 R X |
| 2,842,321 | 7/1958 | Keith | 242/150 M X |
| 2,930,543 | 3/1960 | Goodhue et al. | 242/150 R |
| 2,950,068 | 8/1960 | Rutgers | 242/43 R |
| 2,979,276 | 4/1961 | Bider | 242/54.4 |
| 3,330,492 | 7/1967 | Gonsalves | 242/43 AB |
| 3,359,715 | 12/1967 | Mackie | 242/43 R X |
| 3,421,706 | 1/1969 | Herubel | 242/54.4 |
| 3,670,978 | 6/1972 | Dragisich | 242/54.4 |
| 4,484,436 | 11/1984 | Nakayama et al. | 57/328 |

FOREIGN PATENT DOCUMENTS

| | | | |
|---|---|---|---|
| 0038143 | 10/1981 | European Pat. Off. . | |
| 2454917 | 8/1976 | Fed. Rep. of Germany . | |
| 1391099 | 1/1965 | France | 242/42 |

*Primary Examiner*—Stanley N. Gilreath
*Attorney, Agent, or Firm*—Barnes & Thornburg

[57] ABSTRACT

An arrangement for the winding-up of a double yarn formed of two yarn components that were prestrengthened by pneumatic false-twist spinning onto a cross-wound spool is disclosed. It is provided that between the yarn feeding device and the traverse motion device there is provided a deflecting device for deflecting the double yarn. The yarn deflecting device moves synchronously, but out-of-phase with the traverse motion device to deflect the double yarn with a to-and-fro motion in such a way that always the same moving path length exists for the double yarn between the feeding device and the traverse motion device.

13 Claims, 3 Drawing Sheets

ARRANGEMENT FOR WINDING A DOUBLE YARN ONTO A CROSS-WOUND SPOOL

BACKGROUND AND SUMMARY OF THE INVENTION

The invention relates to an arrangement for the winding of a double yarn formed by two yarn components prestrengthened by means of pneumatic false-twist spinning onto a cross-wound spool in a spinning machine, having a yarn feeding device for the feeding of the double yarn, a traverse motion guide device cross-winding the double yarn on a cross-wound spool, and a driving device for driving the cross-wound spool.

It is known from European Patent Application (EP-A) Publication No. 38 143 to prestrengthen two slivers, that were drawn or drafted by means of a drafting roller device to a desired yarn count, by means of pneumatic false-twist spinning and to subsequently wind them as a double yarn onto a cross-wound spool. The two yarn components have an only relatively low strength. They receive the final strength that is required for the further processing by means of the fact that the double yarn is subsequently twisted together.

When producing cross-wound spools from yarn components of only prestrengthened slivers, certain problems arise. In order to produce a cross-wound spool, a side traverse motion of the double yarn is required, in which case the path of the yarn becomes periodically shorter and longer. When normally strengthened yarns are spun, these changes of length play no important role because they are absorbed by the elastic stretching of the yarns. In many cases, a yarn can therefore be wound up without any additional measures. In other cases, simple balancing structures sufficient that are arranged in a stationary or elastic way. However, in the case of only prestrengthened slivers, these changes of length may result in an additional periodic stretching and thus in a remaining periodic change of length which is connected with yarn defects. It is therefore necessary to proceed with the prestrengthening to such an extent that a certain elastic stretching in the prestrengthened yarns is necessary. However, this degree of prestrengthening is not required for the twisting process that follows because the double yarn in this case is not subjected to similar stress.

An objective of the invention is to develope an arrangement of the initially mentioned type in such a way that changes in the path of the yarn are avoided during the winding-up at a cross-wound spool.

This objective is achieved according to the invention by providing a yarn path deflecting device between the feeding device and the cross-winding device. The yarn path deflecting device is arranged to move synchronously, but out-of-phase with respect to the cross-winding device so as to deflect the double yarn with a to-and-fro motion in such a way that always an approximately equally long path for the double yarn exists between the feeding device and the cross-winding device. By these measures, changes of length during the winding-up are reliably avoided so that less prestrengthening of the yarn components is required and thus a higher production speed can be used, without increasing the danger of yarn breakages to an inadmissible degree.

In a further development of certain preferred embodiments of the invention, it is provided that the cross-winding device and the deflecting device are connected to the same drive. As a result, it is ensured that the synchronous movement between the two devices is constantly guaranteed.

In a further development of certain preferred embodiments of the invention, it is provided that the deflection device moves in a plane that is offset by 90° with respect to the plane in which the cross-winding device moves. In a further development, it is provided in this case that the deflecting device, starting from the shortest yarn deflection, moves only toward one side and with a frequency that is twice as high as the frequency of the movement of the cross-winding device.

Although it is known from German Patent (DE-PS) No. 24 54 917 to provide, between a feeding device and a wind-up device, a swing lever as the yarn-balancing device that is forcibly coupled with the cross-winding of the yarn, this swing lever has the purpose of being able to Produce conical cross-wound spools in which case different spool diameters exist and as a result different winding speeds. This device that is intended for the winding-up of normally strengthened yarns cannot be applied to the winding-up of double yarns consisting of only prestrengthened yarn components.

Other objects, advantages and novel features of the present invention will become apparent from the following detailed description of the invention when considered in conjunction with the accompanying drawings.

DETAILED DESCRIPTION OF THE DRAWINGS

Figure 1:
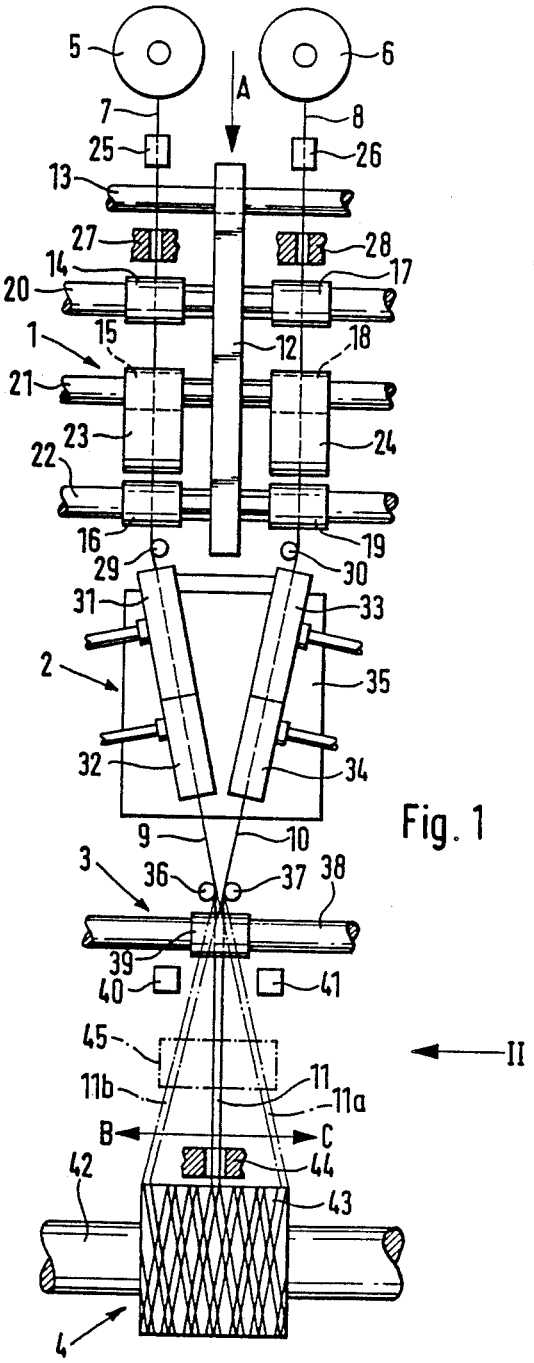
FIG. 1 is a top schematic view of an arrangement for the spinning of two prestrengthened yarn components and for the winding-up of the yarn components as a double yarn onto a cross-wound spool constructed in accordance with a preferred embodiment of the invention.

FIG. 1 is a view from the direction of the operating side of an individual spinning point or unit of a spinning machine that comprises a plurality of spinning units of this type that are arranged in a row next to one another on one or both sides of the machine. Each spinning unit contains two drafting roller devices 1, two false-twisting devices 2, a withdrawal device 3 and a wind-up device 4 that are arranged behind one another in the travel direction of the yarn.

Respectively one sliver 7, 8 is withdrawn from two feed spools 5, 6 that are drawn to the desired yarn size in the respective assigned drawing roller devices 1. In the false-twisting zone 2, the drawn slivers 7, 8 are prestrengthened into yarn components 9, 10 that are subsequently guided together and are withdrawn and wound up as a double yarn 11.

The drafting roller devices 1 each contain driven bottom cylinders 20, 21 and 22 that extend through in the longitudinal direction of the machine and to which respective top rollers 14, 15, 16; 17, 18, 19 are assigned that are held in a joint load support 12. The load support 12 can be swiveled around a holding rod 13 so that the drafting roller devices 1 can be swung open. In the main drafting zone, the drafting roller devices 1 contain apron guides, of which the upper aprons 23, 24 are visible in FIG. 1.

In front of both drafting roller devices 1, sliver guards 25, 26 are connected to which sliver clamps 27, 28 are assigned that are arranged in the inlet area of the drafting roller devices 1. When one of the slivers 7, 8 breaks or is used up, the sliver guards 25, 26, in each case, switch both sliver clamps 27, 28 so that the spinning process is interrupted.

Behind the drafting roller devices 1, yarn guides 29, 30 are arranged that are connected in front of the false-twisting zone 2, in which yarn guides the two slivers 7, 8 are guided toward one another in a V-shape.

The false-twisting zone 2, for each sliver 7, 8, contains two air nozzles 31, 32 as well as 33, 34 that are arranged behind one another in the travel direction A of the yarn The air nozzles 31, 33 that are first in the travel direction A of the yarn are developed as so-called suction nozzles in which a relatively strong air current is generated that points into its axial direction, but which supply to the slivers 7, 8 no twist or at least no significant twist. The air nozzles 32, 34 that follow are developed as twisting nozzles, in which a false-twist is applied to the slivers 7, 8.

In the air nozzles 31, 32; 33, 34, a prestrengthening is applied to the slivers 7, 8 so that prestrengthened yarn components 9, 10 are obtained. Although the false twist that is supplied to the slivers 7, 8 by means of the air nozzles 32, 34 untwists behind the false-twisting zone 2, a portion of the ends of the fibers located on the outside in the slivers 7, 8 was wound around the slivers 7, 8, so that a certain residual twist or residual winding-around remains, by means of which the prestrengthened slivers 9, 10 are obtained. This Prestrengthening that is obtained by the residual winding-around takes place to only such an extent that the yarn components 9, 10 can be wound as a double yarn 11 to a spool 43 without breaking. The final strength is supplied to the double yarn 11 by means of a subsequent twisting process. The air nozzles 31 to 34 are arranged on a joint holding plate 35 that is held in such a way that the air nozzles 31 to 34, in the case of a yarn breakage or in the case of a piecing, can be moved out of the Path of the yarn.

Behind the false-twisting zone 2, the prestrengthened yarn components 9, 10 are guided together by means of yarn guides 36, 37 in such a way that they enter into the withdrawal device 3 with a very slight distance from one another. The withdrawal device 3 comprises a roller 38 that moves through in the longitudinal direction of the machine and is constructed as a driven cylinder, and a pressure roller 39 that, in a way that is not shown in detail, can be swung away, on a swivel arm, from the roller 38 against which roller it is pressed by means of a spring.

From the withdrawal device 3, the double yarn 11 moves to the wind-up device 4. This wind-up device 4 contains a roller 42 that extends in the longitudinal direction of the machine and drives the cross-wound spool 43 by friction, the double yarn 11 being wound-up to form this cross-wound spool 43. The cross-wound spool contains a spool tube onto which the double yarn 11 is wound. This cross-wound spool 43 is held at the tube by means of a known spool holding means that is not shown, and that comprises a swivelable spool frame that is loaded by means of spring loading in the direction of the roller 42.

Between the withdrawal device 3 and the wind-up device 4, yarn guards 40, 41 are arranged which each monitor a yarn component 9, 10 of the double yarn 11. Yarn guards 40, 41 are designed in such a way that even when one yarn component 9 or 10 breaks, a yarn breakage is signaled and the spinning arrangement is stopped, particularly by an actuating of the sliver clamps 27, 28.

In order to be able to wind the double yarn 11 into a cross-wound spool 43, the double yarn 11 must be moved to and fro with a side traverse motion (direction of the arrow B and C) with respect to the cross-wound spool 43. In the case of the shown embodiment, a traverse-motion yarn guide 44 is connected in front of the cross-wound spool 43, the traverse-motion yarn guide 44 being fastened at a traverse-motion rod in a known manner with the traverse-motion rod extending in the longitudinal direction of the machine and being driven to carry out a to-and-fro motion. Instead of a traverse-motion yarn guide 44 of this type, an also known grooved roller may be provided that has a guide groove causing the to-and-fro motion according to other contemplated embodiments. This grooved roller may also be arranged on the wind-up roller 42 according to certain embodiments.

By means of the traverse-motion, different lengths of the path of the moving yarn between the withdrawal device 3 and the wind-up device 4 for the double yarn 11 are created because the double yarn 11, between the end Position shown in dash-dotted lines at the outer dead centers, has to cover longer yarn paths 11*a*, 11*b* than in the area of the spool center. Changes of length of this type, in the case of the double yarn 11 formed of only prestrengthened yarn components 9, 10, may lead to a permanent deformation since these yarn components 9, 10 have only a relatively low strength and practically no elasticity. In order to avoid the danger of these permanent deformations, a length-balancing device 45 is therefore provided between the withdrawal device 3 and the wind-up device 4 that carries out a complete balancing of lengths by means of the deflection of the double yarn 11, so that an approximately equally long moving Path of the yarn constantly exists between the yarn withdrawal device 3 and the traverse-motion yarn guide 44. The length-balancing device 45 forms a loop in the double yarn 11 which varies in size as a function of the position of the traverse-motion yarn guide 44. This loop is the largest when the traverse-motion yarn guide 44 is located in the area of the center of the spool, and is the smallest or is completely opened up when the traverse-motion yarn guide 44 is in each case located at the spool end (yarn moving Paths 11*a*, 11*b*). The length-balancing device 45 therefore operates out-of-phase with respect to the traverse-motion yarn guide 44.

Figure 2:
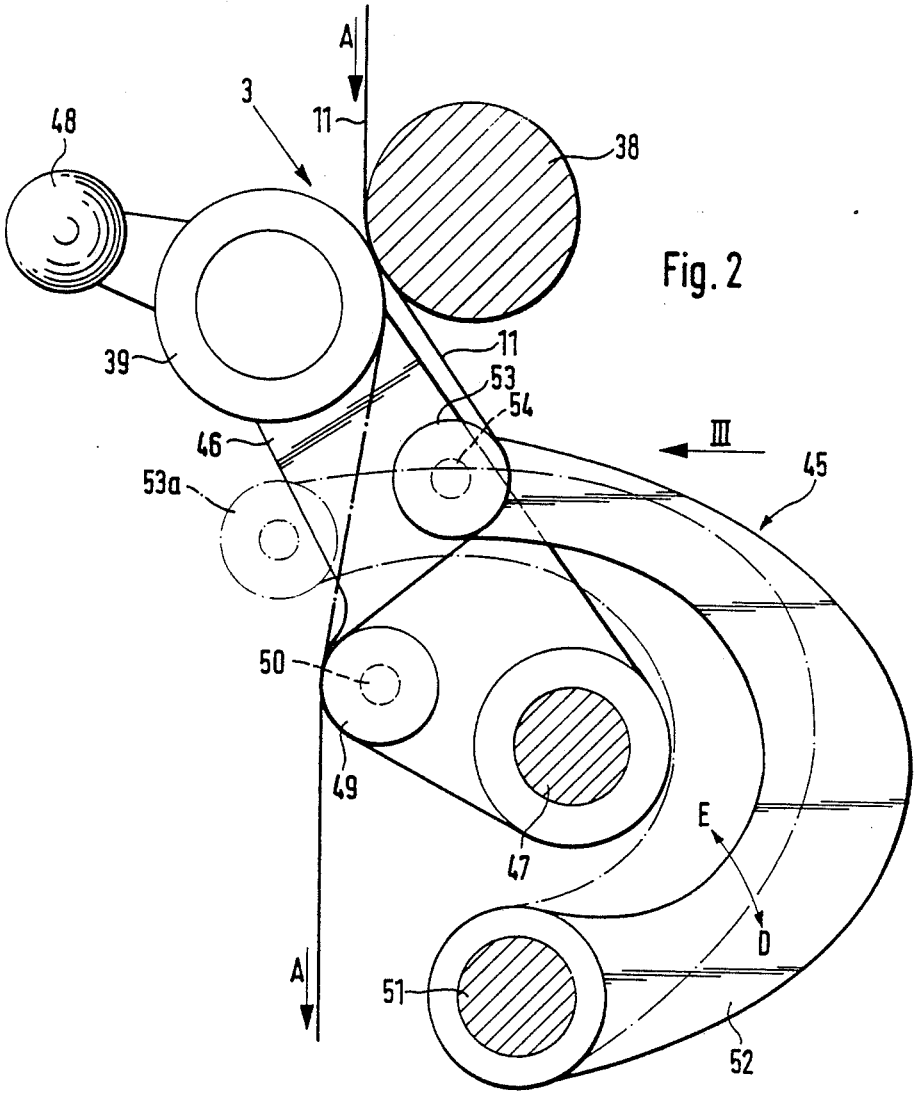
FIG. 2 is an enlarged schematic view showing details of the arrangement according to FIG. 1 taken in the direction of the Arrow II of FIG. 1.

An enlarged illustration of a preferred embodiment of a length-balancing device 45 is shown in FIG. 2. Behind the withdrawal device 3 that has the roller 38 and the pressure roller 39, a guiding roller 49 is arranged. The Pressure roller 39 is disposed on a swivel arm 46 that can be swiveled around a stationary shaft 47 extending through in the longitudinal direction of the machine. This swivel arm 46 is equipped with a handle 48. On the swivel arm 46, the guiding roller 49 is disposed so that it can be rotated freely around a shaft 50, so that when the withdrawal device 3 is closed, it takes up a stationary position.

Between the withdrawal device 3 and the yarn guide 49, a yarn guide 53 is arranged that is developed as a pulley and that can be swiveled between the position 53 shown by solid lines and the position 53*a* shown by dash-dotted lines. The pulley that serves as the yarn guide 53 is disposed on a swing lever 52 so that it can be rotated freely around a shaft 54. Swing lever 52, by means of a shaft 51 extending through in the longitudinal direction of the machine, is driven to perform to-and-fro swinging motions in the direction of the arrows D and E. The shaft 51 is arranged close to the normal moving path of the double yarn 11 so that the yarn guide 53 held by the bent or curved swing lever 52 carries out a movement between the withdrawal device 3 and the yarn guide 49 that is directed by a magnitude of 90° to the straight-line connection between the withdrawal device 3 and the yarn guide 49. The yarn guide 53 arranged on the swing lever 52 deflects the double yarn 11 in the form of a loop with respect to the shortest connection, shown by a dash-dotted line, between the withdrawal device 3 and the yarn guide 49. The lengthening of the path of the yarn movement that results from this loop is dimensioned in such a way that it corresponds to the change of length that the traverse-motion yarn guide 44 requires starting from the center of the spool to one spool side.

As shown in FIG. 2, the yarn guide 53 moves in a plane that is offset by 90° with respect to the plane in which the traverse-motion yarn guide 44 carries out its to-and-fro motion. FIG. 2 also shows that the yarn guide 53 deflects the double yarn 11 with respect to the dash-dotted shortest connection between the withdrawal device 3 and the yarn guide 49 only toward one side. The yarn guide 53 is therefore deflected with twice the frequency of the traverse-motion yarn guide 44 with respect to its motion. The yarn guide 53 therefore, in the case of a double stroke of the traverse-motion guide 44, moves in an out-of-phase way, but synchronously with the double frequency between the deflecting position shown by the solid lines and the dash-dotted position 53*a* in which it releases the double yarn 11.

Figure 3:
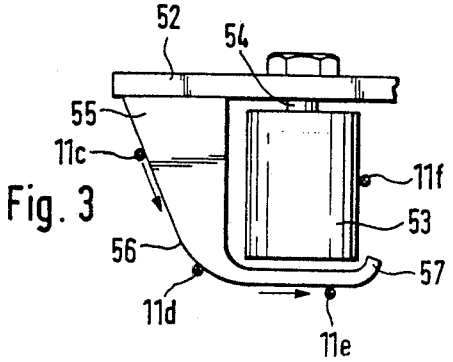
FIG. 3 is a schematic partial view showing a detail of FIG. 2 taken in the direction of the Arrow III.

To the yarn guide 53, that is developed as a loose pulley, a device is assigned by means of which an automatic threading of the double yarn 11 takes place. For this purpose, a guiding element 55 having a yarn guiding surface 56 is mounted at the swing lever 52 (FIG. 3), this guiding element 55, when the yarn guide 53 dips into the moving path of the yarn, providing that the double yarn 11 on the outer contour from position 11*c* via position 11*d* and position 11*e* arrives in position 11*f* on the yarn guide 53 developed as the guiding pulley. For this purpose, the yarn guiding element 55 has a yarn guiding surface 56 that i first sloped diagonally with respect to the shaft 54 of the yarn guide 53, then changes via a round area into a vertical area and changes into a set back end area 57 that reaches slightly over the pulley 53.

Figure 4:
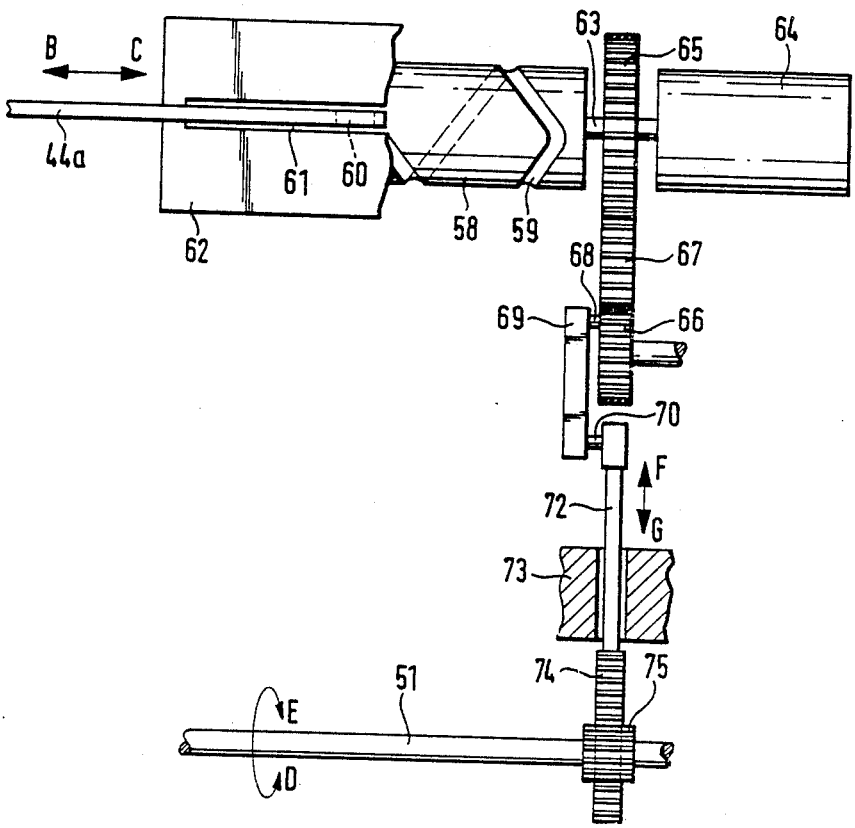
FIG. 4 is a driving diagram for the drive of a cross-winding yarn guide and of a swing lever for the arrangement of FIGS. 1–3.

An embodiment of a joint drive for the traverse-motion yarn guide 44 and the shaft 51 of the yarn length balancing device 45 is shown in FIG. 4. The traverse-motion yarn guides 44 of all spinning Points are arranged on a traverse-motion rod 44*a* that moves through in the longitudinal direction of the machine, the traverse-motion rod 44*a* being driven to perform movements in the direction of the arrows B and C. This traverse motion is taken-off by an inverted-thread shaft 58 that is housed in the headstock of the machine and is driven by an electric motor 64. The inverted-thread shaft 58 is provided with wide, continuously extending, thread-type grooves 59, in which a sliding pad 60 engages that is connected with the traverse-motion rod 44*a*. The sliding pad 60 is guided in a recess 61 of a holding device 62 for the traverse-rod 44. As a result, the rotating motion is changed into a to-and-fro motion.

From the shaft 63 of the electric motor 64, the drive for the shaft 51 of the length-balancing device 45 is also taken off. On the shaft 63, a toothed wheel 65 is arranged that, via a toothed belt 67, is connected with a toothed wheel 66 that has only half the number of teeth of the toothed wheel 65, so that a ratio of 1:2 is obtained. Eccentrically with respect to the axis of rotation, a crank pin 68 is mounted at the toothed wheel 66 into which a connecting rod 69 engages. The other end of the connecting rod 69 is connected with a push rod 72 via a pin 70 that can be slid longitudinally in a slideway 73 (direction of the arrows G and F). The end of the push rod 72 is developed as a toothed rack 74 that mates with an eccentrically moveable toothed wheel 75 arranged on the shaft 51. By means of this crank drive, the rotating motion of the electric motor 64 that is geared up at a ratio of 1:2, is translated into a to-and-fro (arrows D and E) swinging motion of the shaft 51.

In the case of a modified embodiment, it is provided that the double yarn 11, between the traverse-motion yarn guide 44 and the withdrawal device 3, starting from the shortest (dash-dotted) moving path of the yarn, is deflected toward both sides to its longest moving path. For this purpose, the embodiment according to FIG. 2 is modified in such a way that a second yarn guide that may also be developed as a loosely rotating pulley, is assigned to the yarn guide 53 in such a way that the double yarn 11 is held between both yarn guides. In addition to the stationary yarn guide 49, a second yarn guide is arranged on the opposite side of the double yarn 11. In this case, the shaft 51 with the swing lever 52 can be driven at the same frequency as the traverse-motion yarn guide 44.

Although the present invention has been described and illustrated in detail, it is to be clearly understood that the same is by way of illustration and example only, and is not to be taken by way of limitation. The spirit and scope of the present invention are to limited only by the terms of the appended claims.

What is claimed:

1. An arrangement for forming cross-wound spools of double yarn, comprising pneumatic false twist spinning means for forming two pre-strengthened yarn components, feeding means disposed downstream of the false twist spinning means and including means for feeding the two yarn components at a very slight distance from one another, winding spool means for forming a pre-strengthened double yarn package with the two yarn components wound thereon for use in a subsequent finish spinning operation, spool winding means for rotatably driving the winding spool means to form the pre-strengthened double yarn package, cross-winding means disposed between the winding spool means and feeding means for cross-winding the double yarn onto the winding spool means, said cross-winding means including movable traverse motion guide means for guiding the double yarn to the winding spool means, and yarn path deflecting means disposed between the feeding means and the traverse motion guide means for deflecting the double yarn synchronously with the traverse motion guide means so that always an appropriately equally long travel path exists for the double yarn between the feeding means and the traverse motion guide means, said yarn path deflecting means including a first yarn guide element disposed in a relatively fixed position and a second yarn guide element which is movable with respect to the first yarn guide element to vary the yarn path length between the feeding means and the first yarn guide element.

2. An arrangement according to claim 1 wherein automatic threading means are provided for the automatic threading of the double yarn in the second yarn guide element.

3. An arrangement according to claim 1 comprising common drive means for the traverse motion guide means and the yarn deflecting means.

4. An arrangement according to claim 3 wherein the traverse motion guide means includes a drum rotated by the common drive means, a rod operably driven by a pin and helical connection slot connection at the drum, and a traverse motion yarn guide carried by the rod.

5. An arrangement according to claim 3 comprising a shaft which is eccentrically mounted with a gear driven by the common drive means, and wherein said second yarn guide element includes a yarn guide pully carried on said shaft.

6. An arrangement according to claim 5 wherein the traverse motion guide means includes a drum rotated by the common drive means, a rod operably driven by a pin and helical connection slot connection at the drum, and a traverse motion yarn guide carried by the rod.

7. An arrangement according to claim 3 comprising means for moving the second yarn guide element in a plane that is offset by 90° with respect to the plane in which the traverse motion guide means moves.

8. An arrangement according to claim 7 comprising mounting means for mounting the second yarn guide element for movement toward only one side of the double yarn path at a frequency that is twice as high as the frequency of the motion of the traverse motion guide means.

9. An arrangement according to claim 8 comprising a movable swing lever, and wherein said second yarn guide element is disposed on the movable swing lever.

10. An arrangement according to claim 9 wherein automatic threading means are provided for the automatic threading of the double yarn in the second yarn guide element.

11. An arrangement according to claim 1 comprising means for moving the second yarn guide element in a plane that is offset by 90° with respect to the plane in which the traverse motion guide means moves.

12. An arrangement according to claim 11 comprising mounting means for mounting the second yarn guide element for movement toward only one side of the double yarn path at a frequency that is twice as high as the frequency of the motion of the traverse motion guide means.

13. An arrangement according to claim 1 comprising a movable swing lever, and wherein said second yarn guide element is disposed on the movable swing lever.

* * * * *